US006838823B2

(12) United States Patent
Fukushima

(10) Patent No.: US 6,838,823 B2
(45) Date of Patent: Jan. 4, 2005

(54) DISCHARGE LAMP

(75) Inventor: Kensuke Fukushima, Kakogawa (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 81 days.

(21) Appl. No.: 10/438,202

(22) Filed: May 15, 2003

(65) Prior Publication Data

US 2003/0214234 A1 Nov. 20, 2003

(30) Foreign Application Priority Data

May 20, 2002 (JP) ..... 2002-144332

(51) Int. Cl.[7] ..... H01J 17/20
(52) U.S. Cl. ..... 313/571; 313/637
(58) Field of Search ..... 313/490, 567, 313/637, 638, 640, 641, 571

(56) References Cited

U.S. PATENT DOCUMENTS

| | | | | |
|---|---|---|---|---|
| 5,109,181 | A | 4/1992 | Fischer et al. | |
| 5,497,049 | A | 3/1996 | Fischer | |
| 6,504,302 | B2 * | 1/2003 | Nishida | 313/634 |
| 6,653,786 | B2 * | 11/2003 | Fukushima et al. | 313/637 |

* cited by examiner

*Primary Examiner*—Vip Patel
(74) *Attorney, Agent, or Firm*—Nixon Peabody LLP; David S. Safran

(57) ABSTRACT

An ultra-high pressure mercury lamp in which both devitrification and also breakage of the discharge vessel can be eliminated. In the ultra-high pressure mercury lamp, there is a pair of opposed electrodes in a fused silica glass discharge vessel filled at least 0.15 mg/mm$^3$ mercury, and an alkali metal concentration in the area from the inside surface of this discharge vessel to a depth of 4 microns that is at most 10 wt. ppm.

6 Claims, 2 Drawing Sheets

FIG. 2

| Sample | Average Alkali Metal Concentration [1] (ng/μm) | Average Alkali Metal Concentration [2] (wt.ppm) | Degree of Breakage (%) | Average Degree of Maintenance of Illuminance (%) at 300 °C | Assessment |
|---|---|---|---|---|---|
| A | 19.5 | 4.9 | 27.8 | 51 | O |
| B | 54.9 | 13.7 | 35.3 | 44 | X |
| C | 20.1 | 5.1 | 13.3 | 68 | O |
| D | 5.8 | 1.5 | 8 | 80 | O |
| E | 12.4 | 3.1 | 13.8 | 65 | O |
| F | 4 | 1 | 0.7 | 84 | O |
| G | 2 | 0.5 | 0 | 88 | O |
| H | 1.5 | 0.4 | 0 | 90 | O |
| I | 42 | 10.5 | 33.3 | 45 | X |
| J | 44.8 | 11.2 | 28.6 | 48 | X |
| K | 50 | 12.5 | 35.3 | 40 | X |
| L | 39.2 | 9.8 | 24 | 50 | O |
| M | 30 | 7.5 | 22.2 | 62 | O |
| N | 24.8 | 6.2 | 20.7 | 58 | O |
| O | 31.2 | 7.8 | 28.6 | 60 | O |
| P | 32.8 | 8.2 | 29.4 | 51 | O |
| Q | 72 | 18 | 40 | 28 | X |
| R | 66 | 16.5 | 44.4 | 38 | X |

[1] Average alkali metal concentration in an area from the outermost internal surface up to a depth of 4 μm

[2] Calculated as glass weight relation

DISCHARGE LAMP

BACKGROUND OF THE INVENTION

1. Field of the Invention

The invention relates to a high pressure mercury lamp. The invention relates especially to an ultra-high pressure mercury lamp of the short arc type, in which a discharge vessel is filled with greater than or equal to 0.15 mg/mm$^3$ mercury and in which the mercury vapor pressure during operation at least 150 atm.

2. Description of Related Art

In a projector device of a projection type, there is a demand for illumination of images onto a rectangular screen in a uniform manner with adequate color reproduction. Therefore, the light source is a metal halide lamp filled with mercury and a metal halide. Furthermore, recently, smaller and smaller metal halide lamps, as well as more and more often point light sources, have been produced, and lamps with extremely small dimensions between the electrodes have been used in practice.

Instead of metal halide lamps, lamps with an extremely high mercury vapor pressure, for example, with greater than or equal to 200 bar (roughly 197 atm), have been recently proposed. The increased mercury vapor pressure in these mercury vapor lamps suppresses the broadening of the arc, and a considerable increase of the light intensity is provided. This extremely high mercury vapor pressure lamp is disclosed, for example, in Japanese patent disclosure document HEI 2-148561, which is a counterpart of U.S. Pat. No. 5,109,181, and in Japanese patent disclosure document HEI 6-52830, which is a counterpart of U.S. Pat. No. 5,497,049.

In such a light source device used in a projector device, with respect to projection of clear images, it is considered very disadvantageous that devitrification of the discharge lamp occurs. On the other hand, recently the use of the DLP® process (Texas Instruments' Digital Light Processor) using DMD (Texas Instruments Digital Micro-mirror Device) has obviated the necessity of using a liquid crystal cell. For this reason, a still smaller projector device is being used more and more often. On the one hand, there is a demand for high light intensity and a high degree of maintenance of the illuminance of a discharge lamp for a projector device, while, on the other hand, according to the reduction in the size of the projector device, there is a demand for reducing the size of the discharge lamp as well. Hence, there is more and more often a demand for more rigorous operating conditions.

Due to the UV light transmission characteristics of silica glass, it is used as the material of the discharge vessel. The alkali metal component in the silica glass has an adverse effect on the discharge lifetime of the lamp. This mechanism of this effect is broadly described as follows:

Normally, in lamp operation, as a result of radiant heat due to the lamp light and Joulean heat which forms between the electrodes, the lamp body reaches a very high temperature. At this high temperature, the degree of motion of the alkali metal ions (i.e., cations) in the glass is large. The alkali metal ions are attracted from the electrode part by the electrical field formed between the lamp electrodes. In doing so, the alkali metal ions adversely affect the bond between the glass and the electrode part, thus reducing the adhesive strength of the glass/electrode interface. As a result, the service life of the lamp is shortened. The alkali metal component of the inner surface part of the glass accelerates the devitrification of the glass surface during lamp operation, and this becomes the cause of reduction of the illuminance.

Before shipping, the lamps are subjected to a test called aging-after-production in order to sort out faulty products. A process of aging is as follows, for example:

A process of two minutes of operation and one minute off is repeated. Afterwards, an uninterrupted operation of 45 minutes takes place. Conventionally, in ultra-high pressure mercury lamps breakage faults form as a result of detachment in the metal foil components of the hermetically sealed portions during this aging period.

SUMMARY OF THE INVENTION

Therefore, it is an object of the invention to devise an ultra-high pressure mercury lamp for a projector device in which a silica glass discharge vessel is filled with greater than or equal to 0.15 mg/mm$^3$ mercury, and in which both devitrification and also breakage of the discharge vessel can be eliminated.

The amount of the alkali metal portion in the silica glass is disclosed in Japanese patent disclosure document 2001-229876. In this publication, the total amount of the alkali metal portion in the silica glass of a discharge vessel is fixed at less than or equal to 0.6 ppm. This total amount relates to the total amount of alkali metals contained in all the silica glass of a discharge vessel. With respect to the alkali metal concentration in the silica glass tube, a research by the inventor has revealed that there is a concentration gradient (i.e., concentration distribution) from the glass surface to the glass interior in the direction of the thickness of the glass surface. Even if the total amount of alkali metals in the entire glass is less than or equal to 0.6 ppm, there are cases in which the amount of alkali metal has a much higher concentration than 0.6 ppm in the layers near the surface.

The inventor has discovered that, in a glass tube with an etched inside surface, the degree of formation of foil floating and the degree of lamp breakage are better than in a glass tube without etching of the inner surface, with respect to lamps with a glass tube with a chemically etched inner surface and with a glass tube without chemical etching of the inside surface, the glass tubes otherwise being of the same type. The invention, therefore, relates to the alkali metal concentration of the inside surface of the arc tube and fixing this concentration.

The object of the invention is achieved in an ultra-high pressure mercury lamp in which there is a pair of opposite electrodes in a fused silica glass discharge vessel, in which this discharge vessel is filled with greater than or equal to 0.15 mg/mm$^3$ mercury, and in which the alkali metal concentration in the area from the inside surface of this discharge vessel to a depth of 4 microns is less than or equal to 10 wt. ppm.

As used hereinafter, an "alkali metal" means lithium (Li), sodium (Na) and potassium (K).

The reason for fixing the alkali metal concentration in the area from the inside surface of this discharge vessel to a depth of 4 microns is that, as it was assumed that as a result of the diffusion coefficient of the alkali metals in the silica glass, especially the alkali metal concentration from the inside surface of the silica glass to a depth of 4 microns, based on the evaluation of the ion current starting immediately with the initiation of operation, has an effect on the service life characteristic of the lamp (i.e., on the degree of breakage and the degree of maintenance of the illuminance).

The invention is described in further detail below with reference to the accompanying drawings.

BRIEF DESCRIPTION OF THE DRAWINGS

FIG. 2 shows a table illustrating test results of the ultra-high pressure mercury lamp of the invention.

DETAILED DESCRIPTION OF THE INVENTION

Figure 1:
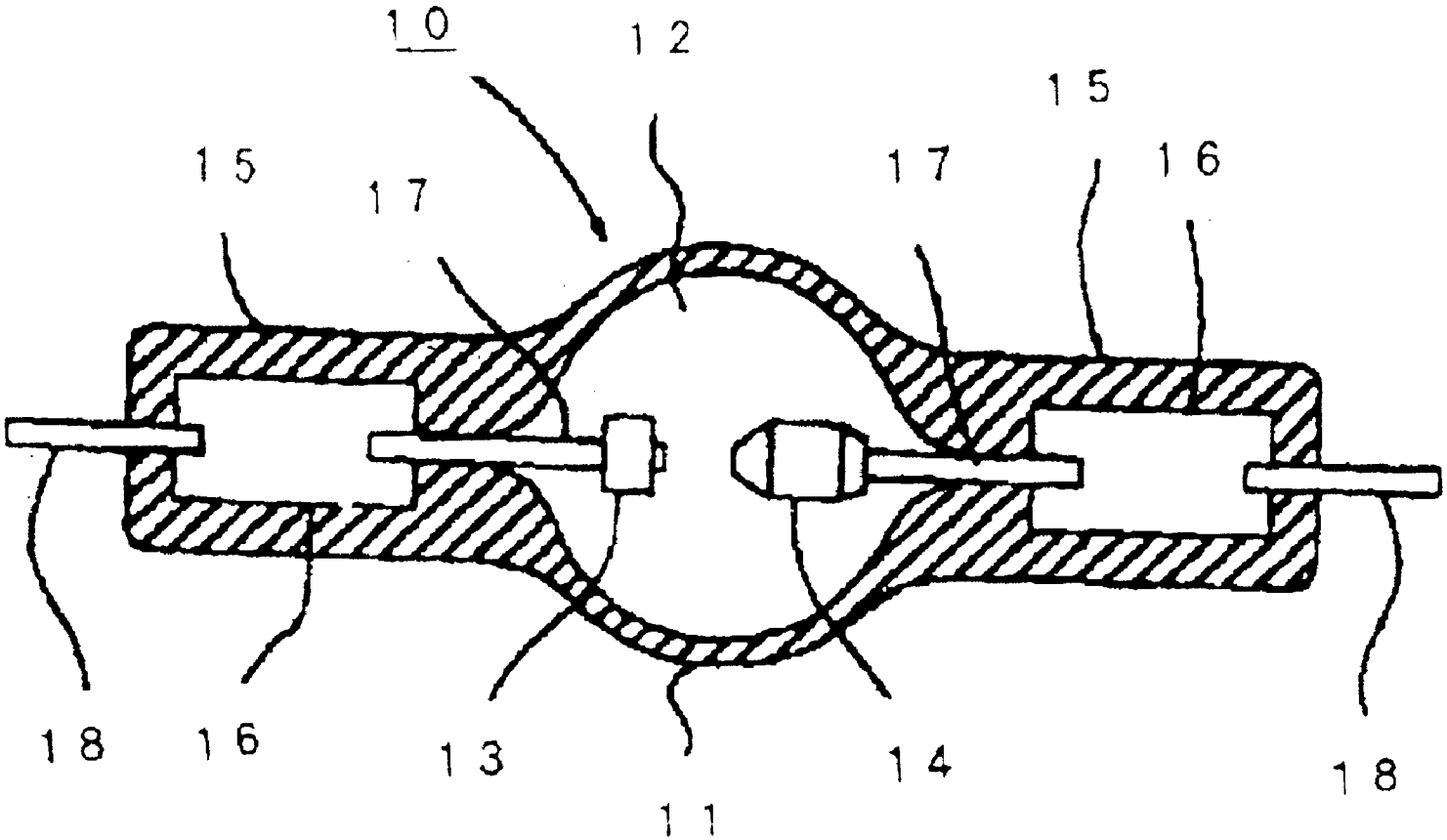
FIG. 1 shows a schematic of the overall arrangement of an ultra-high pressure mercury lamp of the invention.

FIG. 1 shows the overall arrangement of an ultra-high pressure mercury lamp of the invention (hereinafter also called only a "discharge lamp"). The discharge lamp 10 has an essentially spherical discharge space 12 formed by a fused silica glass discharge vessel 11. In this discharge space 12 there are a cathode 13 and an opposed anode 14. From the two ends of the discharge space 12, a hermetically sealed portion 15 extends axially, and normally a molybdenum conductive metal foil 16 is hermetically inserted, for example, by a pinch seal. Furthermore, in the respective hermetically sealed portion 15, the base part of an electrode rod 17, wherein either the cathode 13 or the anode 14 is located, is welded, and, thus, is electrically connected to one end of the conductive metal foil 16, while an outer lead pin 18 which projects to the outside is welded to the other end of the metal foil 16.

The discharge space 12 is filled with mercury, a rare gas, and halogen gas. The mercury is utilized to obtain the required wavelengths of visible radiation. For example, mercury is used to obtain radiant light with wavelengths from 360 nm to 780 nm, and is added in an amount of greater than or equal to 0.15 mg/mm$^3$. This added amount is somewhat different, depending on the temperature conditions. With at least 150 atm during operation, however, an extremely high mercury vapor pressure is reached. By adding a larger amount of mercury, a discharge lamp with a high mercury vapor pressure during operation of at least 200 atm or at least 300 atm can be produced. The higher the mercury vapor pressure, the more suitable a light source for a projector device can be implemented.

The added rare gas is, for example, argon gas of roughly 13 kPa. The rare gas is used to improve the starting property.

The added halogen is iodine, chlorine, and the like in the form of a compound with mercury and other metals. The amount of halogen added can be selected, for example, from the range from $10^{-6}$ to $10^{-2}$ $\mu$mole/mm$^3$. The function of the halogen is to prolong the service life using the halogen cycle. For an extremely small discharge lamp with a high internal pressure, like the discharge lamp of the invention, this filling of halogen influences the phenomenon of breakage or devitrification of the discharge vessel as described below.

The numerical values of such a discharge lamp of the present invention are shown below by way of an experimental example as follows:

the maximum outside diameter of the light emitting part is 9.5 mm;

the distance between the electrodes is 1.5 mm;

the inside volume of the arc tube is 75 mm$^3$;

the wall load is 1.5 W/mm$^3$;

the rated voltage is 80 V; and the rated wattage is 150 W.

This discharge lamp is installed in a projector device or a presentation apparatus, such as an overhead projector, and can offer radiant light with good color reproduction.

Another experiment with respect to the present invention and the effect of the invention is further described below, wherein an ultra-high pressure mercury lamp used:

the maximum outside diameter of the light emitting part is 9.4 mm;

the distance between the electrodes is 1.3 mm;

the inside volume of the arc tube is 75 mm$^3$;

the amount of mercury added was 0.25 mg/mm$^3$;

the amount of halogen added was $10^{-4}$ $\mu$mole/mm$^3$;

the wall load is 1.5 W/mm$^3$;

the rated voltage is 80 V; and the rated wattage is 150 W.

The 18 types of lamp models shown in the table of FIG. 2 with different average alkali metal concentrations in the area from the inside surface of the arc tube to a depth of 4 microns were used in testing. The average alkali metal concentrations in the area from the inside surface of this arc tube to a depth of 4 microns, the breakage state of the discharge vessel during ageing and the reduction of the degree of maintenance of the illuminance due to the formation of a milky opacification were studied.

With respect to the breakage state of the discharge vessel, after one hour of operation of the discharge lamp, as in aging, the breakage state of the discharge vessel was studied and the ratio was recorded in which a break can be detected. In the respective discharge lamp the term "breakage" is defined as a case of formation of cracks in the discharge lamp and a case of destruction of the discharge lamp.

These 18 types of models with different average alkali metal concentrations in the area from the inside surface of the arc tube to a depth of 4 microns were obtained, wherein the alkali metal concentration of the inside surface of the glass tube of fused silica glass after shaping of the arc tube was regulated, and wherein this inside surface was subjected to chemical etching, and, thus, was set to different concentrations.

It becomes apparent from FIG. 2 that, at less than or equal to 10 wt. ppm of the average alkali metal concentrations in the area from the inside surface of the arc tube to a depth of 4 microns, the degree of breakage can be reduced after ageing to less than or equal to 30%. Furthermore, an average degree of maintenance of the illuminance after 300 hours of greater than or equal to 50% can be ensured.

"Less than or equal to 30% of the degree of breakage after ageing" is sufficient with respect to the aging that is carried out for the above-described purpose of excluding or sorting out faulty lamps. "Greater than or equal to 50% of the average degree of maintenance of the illuminance after 300 hours" is a boundary value that is based on the fact that the average degree of maintenance of the illuminance of a lamp produced using a conventional method is less than 50%, although the assessment criterion of the quality of the degree of maintenance of the illuminance is different, depending on the lamp wattage.

An essential aspect of the process for the analysis of the average alkali metal concentrations in the area from the inside surface of the arc tube to a depth of 4 microns is described below. The analysis method was a flameless atomic extinction process (Flameless Atomic Absorption Spectrometry). A commercial analysis device produced by HITACHI was used. This process is generally very well known as the measurement principle. In the process, absorption of light with wavelengths typical of the respective element, i.e. the degree of extinction of the light or the amount of attenuation of the light, is used. Specifically, the degree of extinction at this time is measured by the transmission of the light through a test object. The content of the respective element contained in the test object is evaluated by the magnitude of the degree of extinction.

First, a calibration curve is established, wherein some solutions with known concentrations of the respective target element are prepared, and calibration curves of "concentration against the degree of extinction" are produced. Next, pure water is added to a hydrofluoric acid (HF) solution in which glass with high purity, such as a synthetic silica glass, was dissolved and the solution diluted down to a HF concentration of 5%. Furthermore, alkali metals with any concentrations are added and the degree of extinction of this solution is measured. Next, the change of the degree of extinction with respect to the amount of added alkali is recorded and a calibration curve is established. Based on this calibration curve the alkali content within a model is determined.

The evaluation of the alkali metal concentration in the top layer of the glass is carried out as follows:

i) The inside of the glass tube is filled with an etchant. The inner surface of the tube is uniformly etched, the outside of the tube is not etched. The etchant is 47% HF at 28°C.±1° C.

ii) The weight difference of the glass tube is measured before and after etching, and the etching weight is determined. Microbalance and electronic force balance are used for the glass weight.

iii) Before and after etching, by means of a microlength measurement device the inside diameter of the glass tube is measured. Thus, the amount of change in the direction of thickness is determined. The glass tube is placed in the liquid in order to regulate the index of refraction and to correct the effect which the index of refraction has on the glass surface (i.e., curved surface).

iv) The correlation between the etching weight and the amount of change of the thickness is derived from steps ii) and iii).

v) The inside surface of the glass tube is etched for some a predetermined period of time. In this way, the concentration of the alkali metals contained in this etching liquid is evaluated.

vi) The etching process is repeated. Based on the etching weight the amount of reduction of the thickness (i.e., the depth from the outermost surface) is determined and, thus, the alkali metal concentration in the direction of the inside diameter is determined.

The process for conversion of the unit of the alkali metal concentration from ng/micron into wt. ppm is described below. In this case, the weight per 1 micron of glass thickness is estimated as 4 mg. The conversion from ng/micron into wt. ppm is obtained by the above described value being divided by 4 mg.

The ultra-high pressure mercury lamp of the invention is not limited to operation using a direct current, but can also be used for operation using an alternating current. The reason is that the action of suppressing the devitrification (i.e., the reduction of the degree of maintenance of the illuminance) by the alkali metals in the inside surface of the arc tube is the same as in operation using a direct current.

The ultra-high pressure mercury lamp of the invention can be used in a vertical arrangement of the lengthwise axis of the lamp, in a horizontal arrangement, in an oblique arrangement, and other different operating positions.

The ultra-high pressure mercury of the invention is located in a concave reflector. In the concave reflector there can be a front glass or the like, and, thus, a tightly closed state or an essentially tightly closed state is obtained, or alternately an open state can be obtained without the arrangement of a front glass.

What is claimed is:

1. Ultra-high pressure mercury lamp, comprising a pair of opposed electrodes in a fused silica glass discharge vessel filled at least 0.15 mg/mm$^3$ mercury, wherein an alkali metal concentration in an area from an inside surface of the discharge vessel to a depth of 4 microns is at most 10 wt. ppm.

2. Ultra-high pressure mercury lamp as claimed in claim 1, wherein the inside surface of the discharge vessel is chemically etched.

3. Ultra-high pressure mercury lamp as claimed in claim 2, wherein the inside surface is etched with aqueous hydrofluoric acid.

4. A process for producing an ultra-high pressure mercury lamp comprising a pair of opposed electrodes in a fused silica glass discharge vessel filled at least 0.15 mg/mm$^3$ mercury, wherein an alkali metal concentration in an area from an inside surface of the discharge vessel to a depth of 4 microns is at most 10 wt. ppm. comprising the steps of:

filling the discharge vessel is with a chemical etchant, etching the discharge vessel until an alkali metal concentration in an area from an inside surface of the discharge vessel to a depth of 4 microns is at most 10 wt. ppm.

5. Process as claimed in claim 4, wherein the alkali metal concentration is determined using a flameless atomic extinction process.

6. Process as claimed in claim 4, wherein the etchant is aqueous hydrofluoric acid.

* * * * *